United States Patent [19]

Banning

[11] Patent Number: 4,541,896

[45] Date of Patent: Sep. 17, 1985

[54] SUCTION BOX FOR DEHYDRATING PAPER WEBS

[75] Inventor: Jürgen Banning, Duren, Fed. Rep. of Germany

[73] Assignee: O. Dorries GmbH, Duren, Fed. Rep. of Germany

[21] Appl. No.: 578,216

[22] Filed: Feb. 8, 1984

[30] Foreign Application Priority Data

Feb. 18, 1983 [DE] Fed. Rep. of Germany ..... 3305539

[51] Int. Cl.[4] ..... D21F 1/50

[52] U.S. Cl. ..... 162/363; 162/366; 162/373; 162/374

[58] Field of Search ..... 162/314, 363, 373, 374, 162/308, 351, 217, 312, 110, 366

[56] References Cited

U.S. PATENT DOCUMENTS 3,649,449 3/1972 Nykopp ..... 162/374
4,055,459 10/1977 Best ..... 162/374
4,145,249 3/1979 Hansen ..... 162/210
4,406,739 9/1983 Kankaanpaa ..... 162/363

*Primary Examiner*—S. Leon Bashore
*Assistant Examiner*—Andrew J. Anderson
*Attorney, Agent, or Firm*—Albert L. Jeffers; Stephen T. Belsheim

[57] ABSTRACT

A suction box coordinated with a dandy roll and serving the dehydration of paper webs features on its ends respective deckle slides wherein each deckle slide is of a design such that it elastically yields to the peripheral face of the dandy roll. Each deckle slide is wear-resistant and adaptable to varying dandy roll diameters and dipping depths. Thus, each deckle slide comprises a lamella package which extends with its longitudinal axis in the direction of web travel. The lamella package includes a plurality of parallel, rigid lamellae shiftable relative to one another and lying in respective planes extending generally perpendicular to the direction of web travel.

12 Claims, 2 Drawing Figures

SUCTION BOX FOR DEHYDRATING PAPER WEBS

This invention pertains to a suction box, and more particularly to an improved suction box including elastically yieldable deckle slides for dehydrating paper webs.

A similar prior art suction box is disclosed in the book Keim, "Sieb und Filz", 3. edition 1968, Guentter-Staib-Verlag, Biberach/Riss, pages 198–199. The deckle slides of this prior art suction box feature a sponge seal made of soft rubber or similar material, and these sealing sponges adapt to the dandy roll, which dips more or less deep into the suction box. Undesirable features associated with these types of sealing sponges are that they provide little resistance and require replacement after a short operating time.

One of the problems underlying the purpose of the present invention is to provide a suction box having deckle slides that are wear-resistant and easily adaptable to dandy rolls of various diameters and dipping depths.

This problem is uniquely solved in that each deckle slide supports a package of lamellae having its longitudinal axis extending in the direction of web travel, and including a plurality of parallel rigid lamellae shiftable relative to one another and lying in respective planes generally perpendicular to the direction of web travel. These lamellae are capable of yielding elastically into the deckle slide to various depths depending upon the diameter and dipping depth of a particular dandy roll. In this process, the lamellae that have been shifted the farthest are only insignificantly stressed relative to those lamella at the end sides of the lamellae package. Since the lamellae are made of a non-compressible material, they return to their original position upon being relieved.

The lamella package is suitably disposed in a box, which has an opening facing toward the dandy roll, and which bears on an elastic body, for example, a foam rubber cushion.

One form of the invention provides for connecting a rinsing water line to a portion of the box holding the lamella package at a point remote from the dandy roll. This arrangement offers the advantage that paper material particles which have penetrated in between the lamellae can be flushed out with water, thereby ensuring smooth lamella movement.

To obtain a particularly long lamella life, the lamellae are preferably made of a wear-resistant material, such as a suitable plastic material or ceramic material.

In order to prevent the dandy roll and the wire edge passing over the lamella package from wearing, the lamellae ends facing the dany roll have respective convex surfaces extending generally parallel to the longitudinal axis of the dandy roll.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
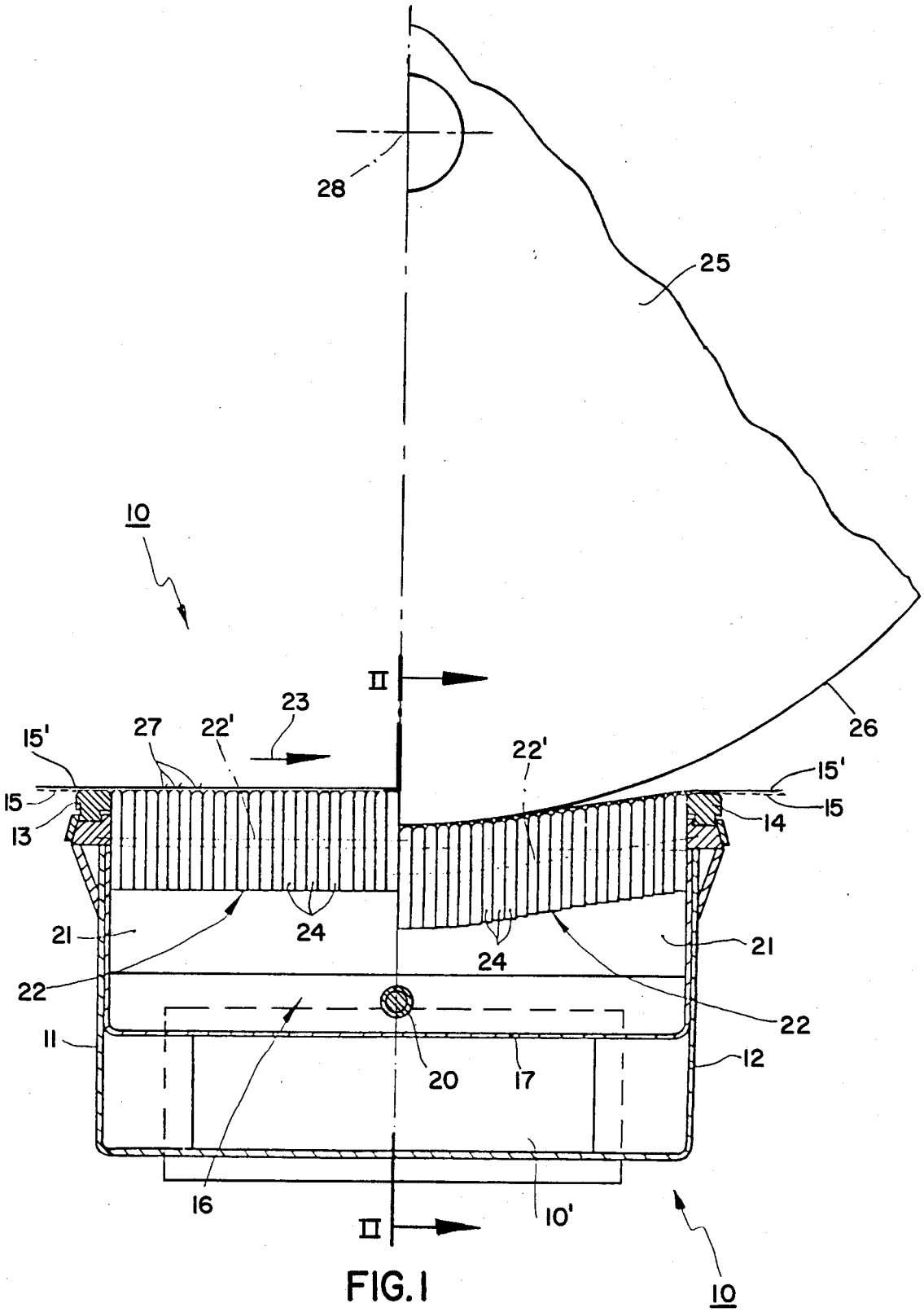
FIG. 1 is a cross-section through a suction box along lines I—I in FIG. 2, with a deckle slide illustrated unstressed in the left half of the figure, and stressed by a dandy roll in the right half of the figure.
Figure 2:
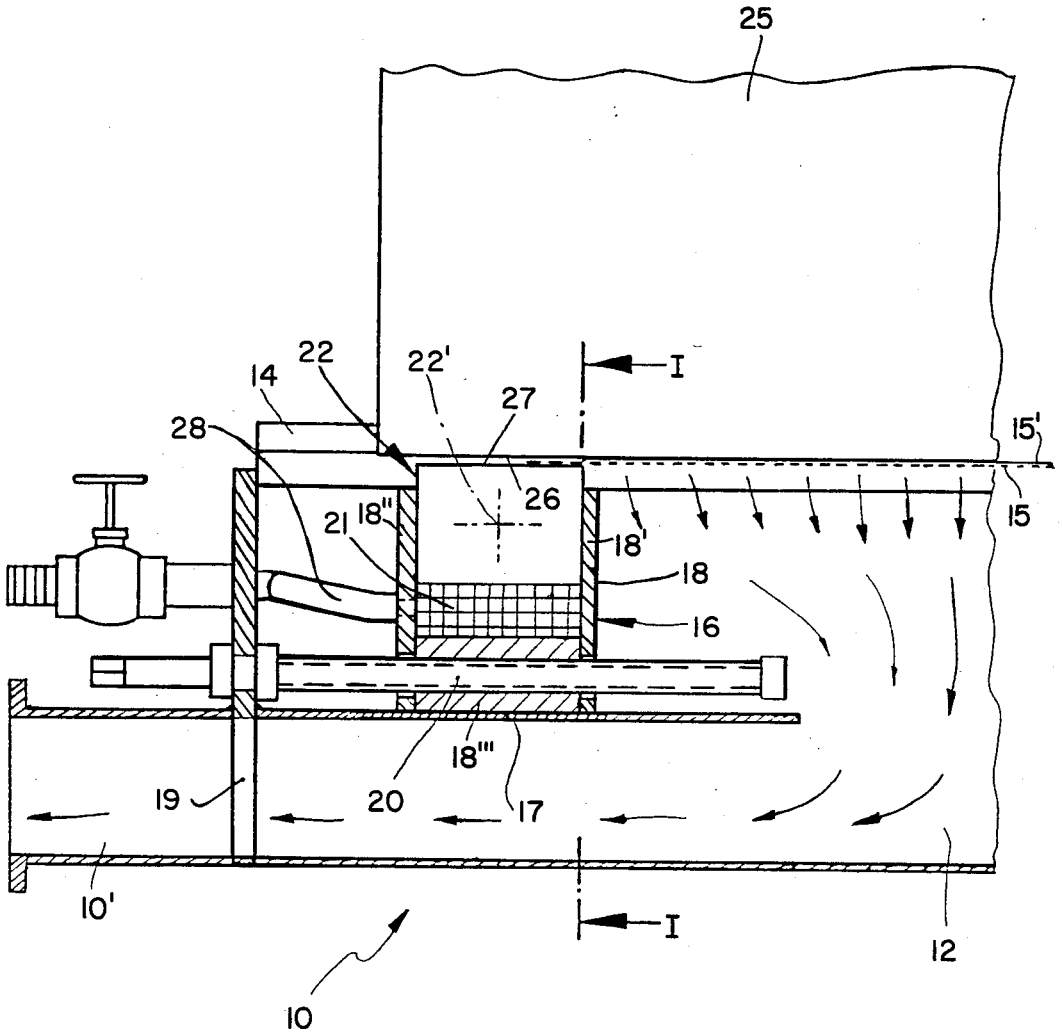
FIG. 2 is a partially cut-away end section of the suction box in FIG. 1 with the deckle slide shown in section.

Referring to FIGS. 1 and 2, open-top suction box 10 includes side walls 11 and 12 fitted with respective support bars 13, 14 for supporting wire 15 passing across box 10 with a paper web 15' which is to be dehydrated. Disposed in the end sections of suction box 10 are deckle slides 16 mounted on intermediate bottom 17. Suction box 10 further includes a suction socket 10' through which water is withdrawn from the paper web 15' and removed from box 10 as illustrated by the arrows in FIG. 2.

Each deckle slide 16 features an open-top box 18 which has side walls 18' and 18'' and bottom wall 18''' which engages lead screw 20. Box 18 can be repositioned by means of lead screw 20, which is mounted in end wall 19 of suction box 10 (FIG. 2). Contained in box 18 is foam rubber cushion 21, which elastically carries on the top thereof lamella package 22. In FIGS. 2, the deckle slide 16 is positioned so that lamella package 22 borders the edge of paper web 15' and screen 15 extends over the lamellae 24. Lamella package 22 is disposed in box 18 such that it extends with its longitudinal axis 22' in the direction of web travel as indicated by arrow 23 in FIG. 1 Lamella package 22 comprises a plurality of parallel, rigid lamellae 24. Each lamella 24 is made from a wear-resistant material, such as a plastic material or a ceramic material. Lamellae 24 are shiftable relative to one another in planes extending substantially perpendicular to the direction of web travel 23 against the slight resistance offered by foam rubber cushion 21 as a dandy roll 25 is positioned on wire 15 and dips partly into suction box 10. As follows clearly from the right half of FIG. 1, lamellae 24 adapt in the middle section of the lamellae package 22 to the roll periphery 26 and, toward support bar 14, to the subsequent tangential extension of wire 15. The remote ends 27 of lamellae 24 facing towards dandy roll 25 have their surfaces formed with a convex contour and extend generally parallel to the longitudinal axis of dandy roll 5.

Connected to deckle slide box 18 at a portion thereof remote from dandy roll 25 and through end 19 of suction box 10 is rinsing water line 28 (FIG. 2). Water fed to box 18 through water line 28 penetrates foam rubber cushion 21 and flows between lamellae 24 to thereby flush paper material particles contained therebetween.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A suction box in combination with a dandy roll for dehydrating paper webs and including deckle slides elastically yieldable to the peripheral face of said dandy roll, characterized in that each said deckle slide comprises a lamella package having its longitudinal axis disposed in the direction of web travel, each said lamella package including a plurality of parallel rigid lamellae shiftable relative to one another in respective planes substantially perpendicular to the direction of web travel.

2. The suction box of claim 1 wherein each said lamella package is disposed in a box member open towards said dandy roll, and said lamella package bearing on an elastic body means.

3. The suction box of claim 2 wherein said box member has connected to a portion thereof remote from said dandy roll a rinsing water line.

4. The suction box of claim 1 wherein said lamellae are made of a wear-resistant material.

5. The suction box of claim 4 wherein said wear-resistant material is one of a plastic material or a ceramic material.

6. The suction box of claim 4 wherein said lamellae have their respective ends facing said dandy roll formed with a convex contour extending substantially parallel to the longitudinal axis of said dandy roll.

7. A suction box for use with a dandy roll having a peripheral face and serving to dehydrate paper webs comprising elastically yieldable deckle slides adapted to elastically yield to the dandy roll peripheral face, each said deckle slide includes a lamella package having its longitudinal axis in the direction of web travel, said lamella package including a plurality of noncompressible parallel lamellae movable relative to one another in respective planes substantially perpendicular to the direction of web travel.

8. The suction box of claim 7 wherein said lamella package is disposed in a container having an opening facing upwardly, said lamella package resting on an elastic medium.

9. The suction box of claim 8 wherein said container has a rinsing water line connected thereto for flushing paper material particles from said lamellae.

10. The suction box of claim 7 wherein said lamellae are made of a wear-resistant material.

11. The suction box of claim 10 wherein said wear-resistant material is one of a plastic material or a ceramic material.

12. The suction box of claim 10 wherein the upwardly facing remote ends of said lamellae are formed with respective convex surfaces, said convex surfaces being adapted to extend generally parallel to the longitudinal axis of the dandy roll.

* * * * *